US007633047B2

(12) United States Patent
Kim

(10) Patent No.: US 7,633,047 B2
(45) Date of Patent: Dec. 15, 2009

(54) NON-CONTACT OPTICAL SENSOR MODULE

(75) Inventor: Ho Kyoum Kim, Suwon (KR)

(73) Assignee: Samsung Electro-Mechanics Co., Ltd., Suwon (KR)

( * ) Notice: Subject to any disclaimer, the term of this patent is extended or adjusted under 35 U.S.C. 154(b) by 0 days.

(21) Appl. No.: 11/979,744

(22) Filed: Nov. 7, 2007

(65) Prior Publication Data

US 2008/0111707 A1 May 15, 2008

(30) Foreign Application Priority Data

Nov. 15, 2006 (KR) ..... 10-2006-0112593

(51) Int. Cl.
*G06M 7/00* (2006.01)

(52) U.S. Cl. ..... 250/221; 345/157

(58) Field of Classification Search ..... 250/221, 250/214 SW; 345/157, 175, 176
See application file for complete search history.

(56) References Cited

U.S. PATENT DOCUMENTS

| | | | | |
|---|---|---|---|---|
| 6,045,047 | A * | 4/2000 | Pidhirny et al. | 235/472.01 |
| 6,476,417 | B2 * | 11/2002 | Honda et al. | 257/59 |
| 6,727,564 | B2 * | 4/2004 | Shinomiya | 257/432 |
| 2001/0010562 | A1 * | 8/2001 | Nakagishi et al. | 348/374 |
| 2001/0050717 | A1 * | 12/2001 | Yamada et al. | 348/340 |
| 2001/0055073 | A1 * | 12/2001 | Shinomiya | 348/374 |
| 2005/0056769 | A1 * | 3/2005 | Chen | 250/208.1 |
| 2005/0059269 | A1 * | 3/2005 | Kim et al. | 439/66 |
| 2006/0028442 | A1 * | 2/2006 | Bynum et al. | 345/157 |
| 2007/0126898 | A1 * | 6/2007 | Feldman et al. | 348/294 |
| 2008/0218474 | A1 * | 9/2008 | Ahn et al. | 345/158 |

FOREIGN PATENT DOCUMENTS

| | | |
|---|---|---|
| JP | 8-248285 | 9/1996 |
| JP | 2004-221874 | 8/2004 |
| KR | 10-2003-0048254 | 6/2003 |
| KR | 10-2004-0005307 | 1/2004 |
| KR | 10-2006-0034735 | 4/2006 |

OTHER PUBLICATIONS

Office Action mailed on Mar. 12, 2008 and issued in corresponding Korean Patent Application No. 10-2006-0112593.

* cited by examiner

*Primary Examiner*—Seung C Sohn
(74) *Attorney, Agent, or Firm*—Staas & Halsey

(57) ABSTRACT

Provided is an optical sensor module including a printed circuit board (PCB) having a pad with a perforated portion formed in the central portion thereof; a lens disposed on the top surface of the pad so as to cover the perforated portion; one or more light sources disposed around the lens; an image sensor closely attached to the bottom surface of the pad; and a housing mounted to surround the outer periphery of the image sensor, the housing having the same height as that of the image sensor and the same size as that of the pad.

5 Claims, 4 Drawing Sheets

[FIG. 1]
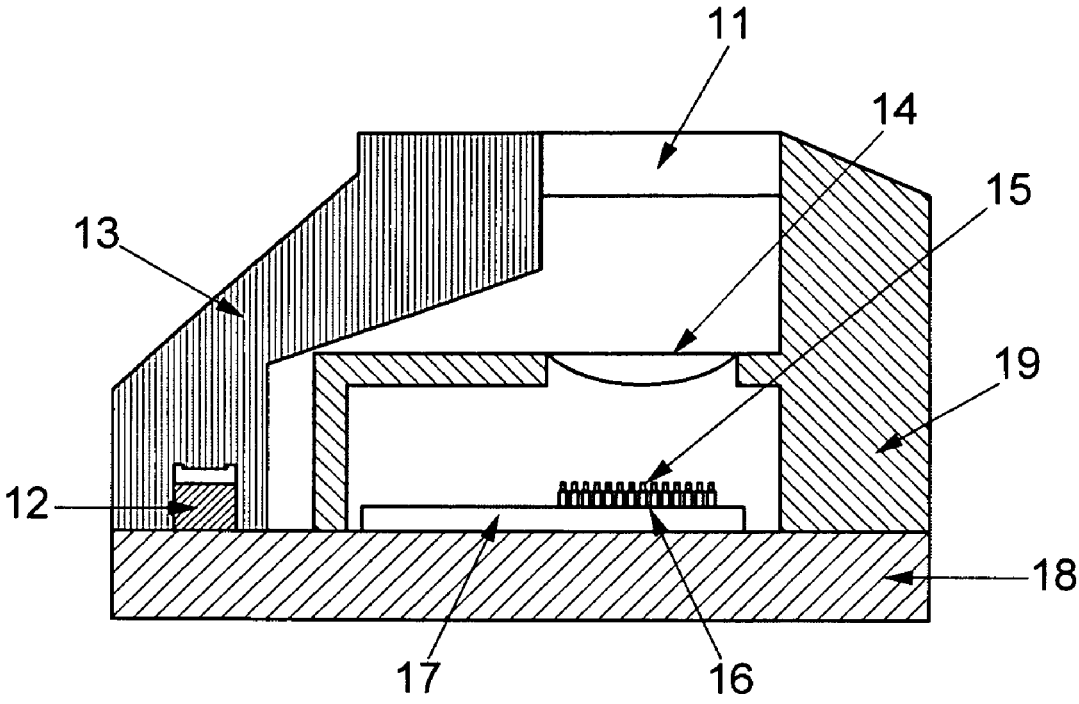
- PRIOR ART-

[FIG. 2]
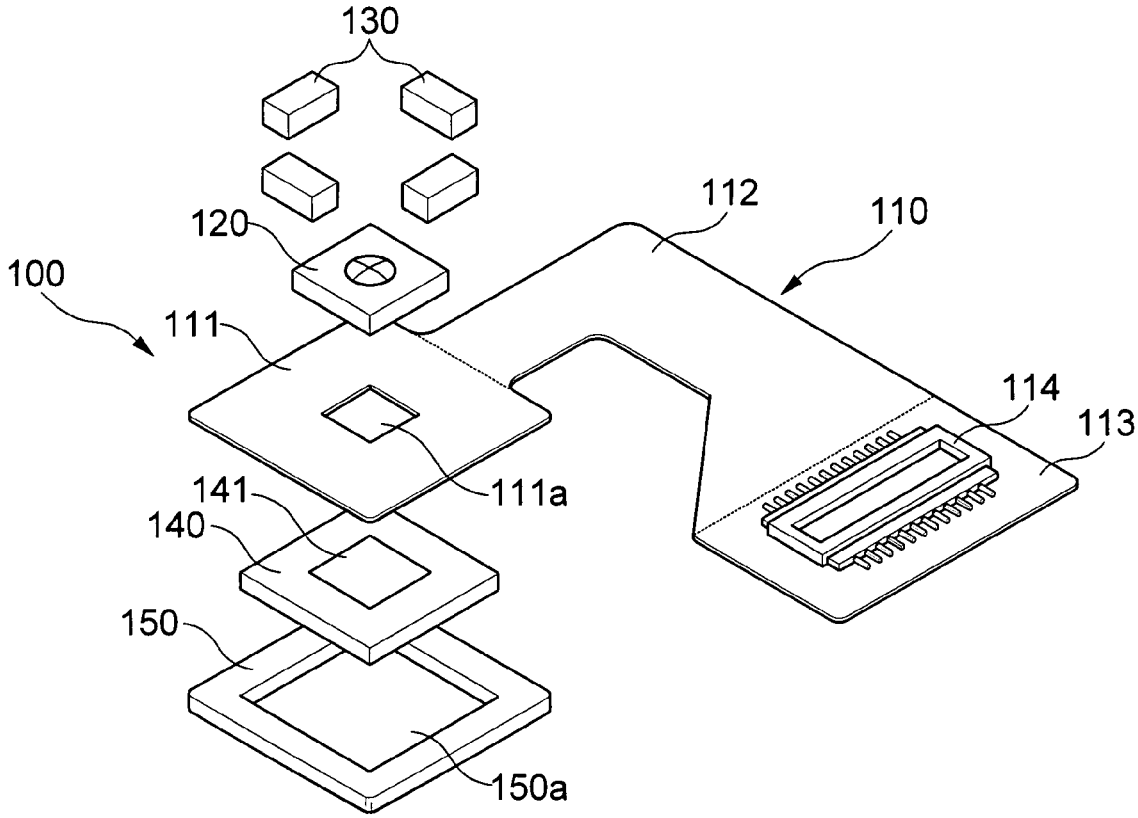

[FIG. 3]
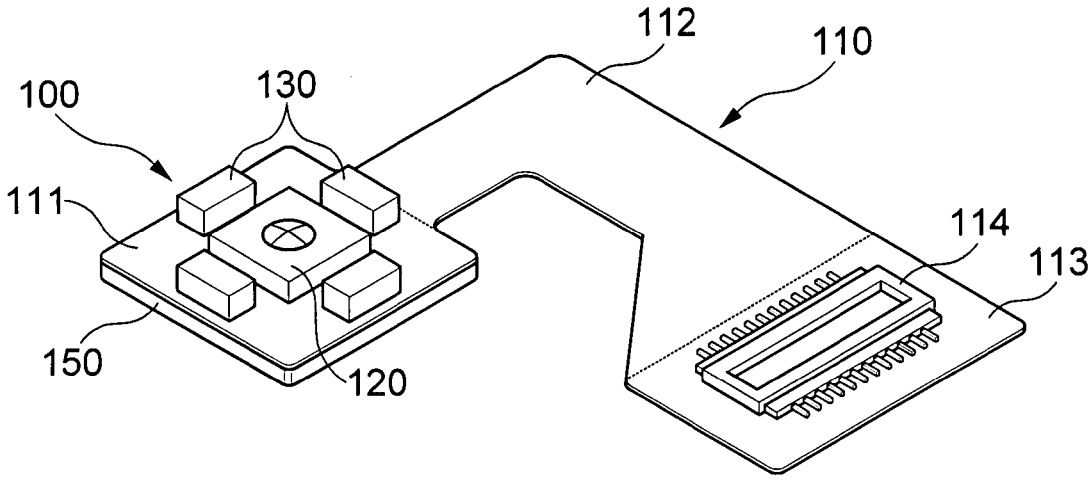
[FIG. 4]
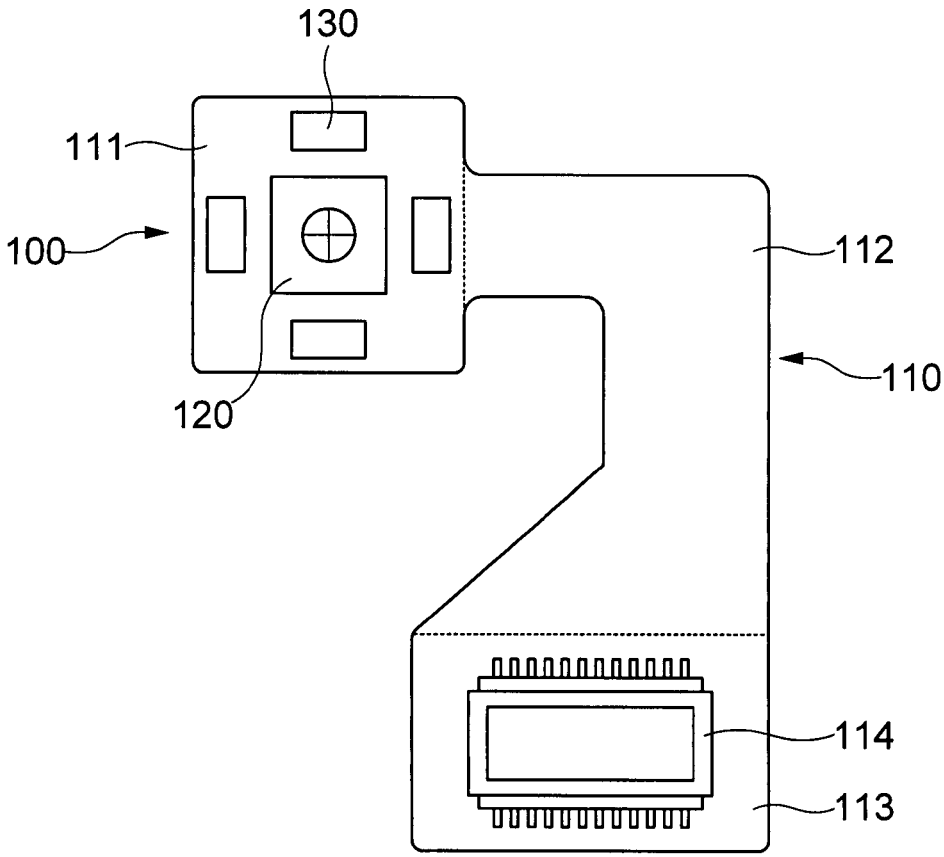

[FIG. 5]
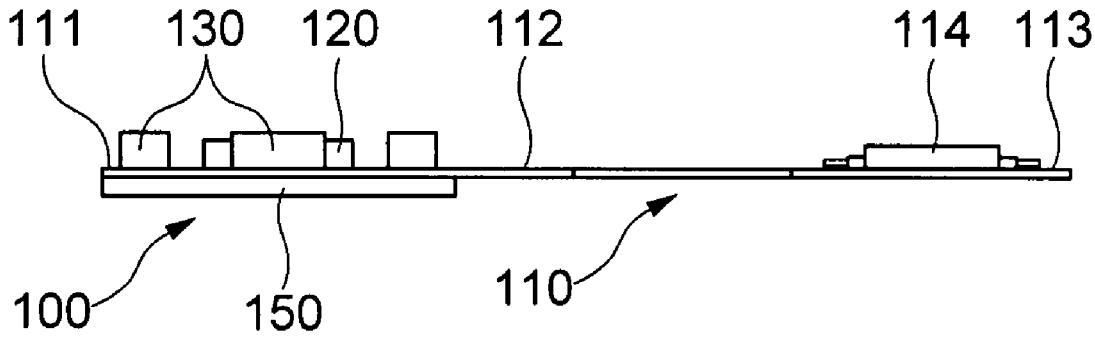
[FIG. 6]
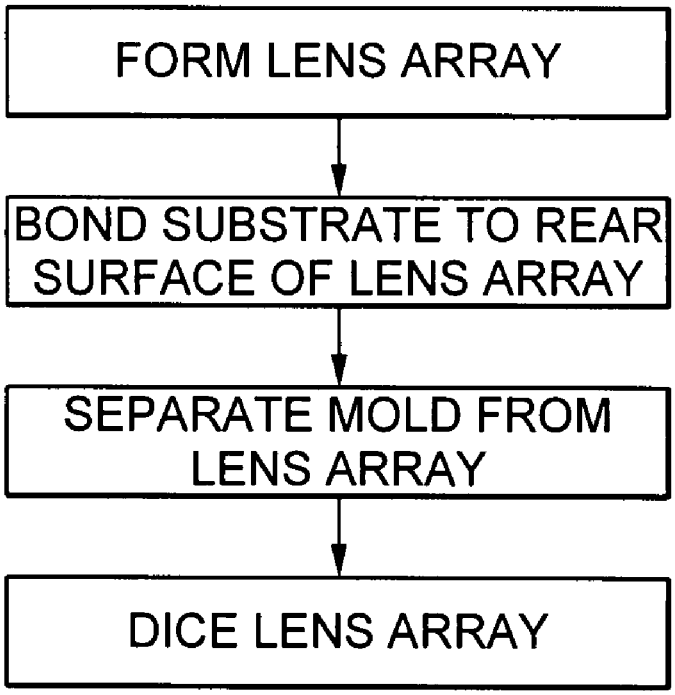

NON-CONTACT OPTICAL SENSOR MODULE

CROSS-REFERENCE TO RELATED APPLICATIONS

This application claims the benefit of Korean Patent Application No. 10-2006-0112593 filed with the Korea Intellectual Property Office on Nov. 15, 2006, the disclosure of which is incorporated herein by reference.

BACKGROUND OF THE INVENTION

1. Field of the Invention

The present invention relates to an optical sensor module which detects the motion of light irradiated from light emitting diodes (LEDs) such that a button function of a mobile electronic apparatus can be implemented in a non-contact manner.

2. Description of the Related Art

In general, a character input of small-sized mobile electronic apparatuses including mobile phones is carried out by pressing or touching a key pad.

The reason why an input method using such a key pad is mainly used in small-sized mobile electronic apparatuses is that there is a limit in the thickness of sensor modules used in other input methods. Further, when sensor modules with a relatively large thickness are used, there are difficulties in reducing the size of small-sized electronic apparatuses including mobile phones.

In one of the other input methods, a Graphic User Interface (GUI) environment such as a figure or character plate or the Window of a computer is implemented on an LCD screen. Then, a cursor is moved to input a figure or character, or to click an icon, thereby carrying out a menu input.

In this method, as a finger (object) is moved on an optical sensor module so as to move a cursor on a screen, a specific figure or icon is input. Therefore, the finger (object) is moved on the optical sensor module so as to click a specific figure, character, or icon. When the finger (object) is separated, an input or cancellation of the selected figure, character, or icon is carried out.

Such an optical sensor module is applied to an optical mouse for transmitting an input signal to a computer. In the optical sensor module applied to the optical mouse, an object surface faces downward. Therefore, light from a light source is irradiated downward. Further, a lens is positioned in a lower portion of the optical image sensor such that a cursor on the screen is moved by the motion of the optical mouse.

To apply such an optical sensor module to small-sized electronic apparatuses such as mobile phones, a finger (object) should be moved from an upper direction of the object surface such that the motion thereof is detected. Therefore, the surface of the optical sensor module should face upward, and a lens should be positioned on the image sensor surface.

In such a structure, however, the object surface on which an object is positioned, an lens system, and the image sensor should be aligned vertically with the direction of an optical axis. Therefore, the height of the optical sensor module inevitably increases, because of a limit in focal distance of the lens. Therefore, it is difficult to apply the optical sensor module to small-sized electronic apparatuses such as mobile phones which are gradually reduced in size.

To solve such a problem, Korea Patent Laid-open Publication No. 2006-34735 discloses a conventional optical sensor module (titled by 'Ultra-slim Optical Joystick using Micro Array Lens Structure').

FIG. 1 is a cross-sectional view of a conventional optical sensor module. The conventional optical sensor module includes a cover glass 11, a light source (LED) 12, an optical waveguide (illumination system) 13, a plano-convex lens 14, an image sensor 17, a printed circuit board (PCB) 18, and a barrel 19.

In the conventional optical sensor module, when a finger (object) 19 is placed on the surface of the cover glass 11, light irradiated onto the cover glass 11 is reflected by the object so as to be primarily concentrated by the plano-convex lens 14. Then, the light is secondarily concentrated by a micro lens array 15 such that an image is formed in a pixel of an imaging region 16.

In the conventional optical sensor module, a barrel (not shown) for fixing the lens 14 and a housing for fixing the barrel are separately used. Further, a retainer for adjusting a quantity of light incident from upward is needed in an upper portion of the lens 14 within the housing. Therefore, there is a limit in reducing the height of the module. Further, it is difficult to apply the optical sensor module to small-sized electronic apparatuses such as mobile phones which are gradually reduced in size.

SUMMARY OF THE INVENTION

An advantage of the present invention is that it provides an optical sensor module which detects the motion of light irradiated from LEDs such that a button function of a mobile electronic device can be implemented in a non-contact manner.

Additional aspects and advantages of the present general inventive concept will be set forth in part in the description which follows and, in part, will be obvious from the description, or may be learned by practice of the general inventive concept.

According to an aspect of the invention, an optical sensor module comprises a printed circuit board (PCB) having a pad with a perforated portion formed in the central portion thereof; a lens disposed on the top surface of the pad so as to cover the perforated portion; one or more light sources disposed around the lens; an image sensor closely attached to the bottom surface of the pad; and a housing mounted to surround the outer periphery of the image sensor, the housing having the same height as that of the image sensor and the same size as that of the pad.

Preferably, the PCB is a flexible printed circuit board (FPCB) having the pad provided at one end thereof and a substrate connection portion provided at the other end thereof, the substrate connection portion having a connector mounted thereon. Further, the FPCB is a single-sided or double-sided FPCB.

Preferably, the light sources are composed of infrared light emitting diodes (LEDs), which emit infrared light right upward.

Preferably, in the infrared LEDs, light incident through the lens depending on an external environment enters the image sensor, the intensity of the light is detected by a light quantity detecting section which is separately provided inside or outside the image sensor, and a voltage is adjusted by a circuit built in the substrate such that the illumination intensity of the infrared LEDs is adjusted.

Preferably, the lens is formed of a sag lens manufactured in a wafer state. Further, the optical sensor module is formed to have a height of 0.7 to 2.0 mm.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which:

FIG. 1 is a cross-sectional view of a conventional optical sensor module;

FIG. 2 is an exploded perspective view of an optical sensor module according to the invention;

FIG. 3 is an assembled perspective view of the optical sensor module according to the invention;

FIG. 4 is a plan view of the optical sensor module according to the invention;

FIG. 5 is a side view of the optical sensor module according to the invention; and FIG. 6 is a diagram for explaining a manufacturing method of a sag lens adopted in the optical sensor module according to the invention.

DETAILED DESCRIPTION OF THE PREFERRED EMBODIMENTS

Reference will now be made in detail to the embodiments of the present general inventive concept, examples of which are illustrated in the accompanying drawings, wherein like reference numerals refer to like elements throughout. The embodiments are described below in order to explain the present general inventive concept by referring to the figures.

Hereinafter, an optical sensor module according to the present invention will be described in detail with reference to the accompanying drawings.

FIG. 2 is an exploded perspective view of an optical sensor module according to the invention. FIG. 3 is an assembled perspective view of the optical sensor module according to the invention. FIG. 4 is a plan view of the optical sensor module according to the invention. FIG. 5 is a side view of the optical sensor module according to the invention.

As shown in the drawings, the optical sensor module 100 according to the invention includes a PCB 110, a lens 120 disposed on a pad 111 of the PCB 110, a plurality of light sources 130 disposed around the lens 120, and a housing 150 having an image sensor 140 which is closely attached to the bottom surface of the pad 111.

The PCB 110 is formed of a single-sided or double-sided flexible printed circuit board (FPCB), in which the pad 111 and a substrate connection portion 113 are respectively formed to extend from both sides of a substrate 112 formed of a flexible material.

In the PCB 110, a socket-type connector 114 is mounted on the substrate connection portion 113 such that the PCB 100 is connected to an external device. Alternately, the substrate connection portion 113 is composed of a slide-type side connector. Further, the pad 111 of the PCB 110 has a circuit pattern formed therein such that module composing members disposed on and under the pad 111 can be electrically connected.

Further, the pad 111 extending in the form of thin film has the lens 120 and the light sources 130 disposed thereon, the light sources 130 emitting light toward an object of which the motion is to be detected.

The lens 120 is closely attached to the top surface of the pad 111 such that a perforated portion 111*a* formed in the center of the pad 111 is covered by the lens 120. At least one or more light sources 130 are disposed in the vicinities of the lens 120 including the respective sides of the lens 120.

In this case, the lens 120 is manufactured in a wafer state. Preferably, the lens 120 is formed of a sag lens of which the focal distance is extremely short. Further, the lens 120 is manufactured by a molding process. The manufacturing method thereof will be described below in detail.

Further, the light sources 130 disposed around the lens 120 are composed of infrared light emitting diodes (LED) which emit infrared light right upward.

Additionally, the illumination intensity of the light sources 130 composed of infrared LEDs is adjusted by the following process. First, light incident through the lens 120 enters the image sensor 140, and the intensity of the light is detected. Then, as a voltage is adjusted by a circuit built in the substrate 110, the illumination intensity is adjusted.

In this case, a separate light quantity detecting unit (not shown) is provided inside or outside the image sensor 140 so as to detect a quantity of light incident through the lens 120.

The housing 150 is coupled to the pad 111 having the lens 120 disposed thereon so as to fix and protect the image sensor 140 which is closely attached to the bottom surface of the pad 111.

That is, the image sensor 140 is mounted in such a manner that a light receiving section 141 of the image sensor 140 is exposed to the perforated portion 111*a* of the pad 111. In this case, the light receiving section 141 faces the lens 120 with the pad 111 interposed therebetween. Further, the image sensor 140 is inserted into a through hole 150*a* formed in the central portion of the housing 150 so as to be more reliably fixed to the bottom surface of the pad 111.

The housing 150 is formed to have the same size as that of the pad 111 and the same height as that of the image sensor 140. Therefore, depending on the size of the pad 111, the size of the module can be minimized.

In the optical sensor module 110 constructed in such a manner, when the image sensor 140 and the lens 120 are closely attached by a flip-chip bonding method using the PCB 111, the image sensor 140 is closely attached to the bottom surface of the pad 111 of the PCB 111, and simultaneously, the sag lens 120 of which the focal distance is extremely short is disposed on the pad 111. Therefore, it is possible to manufacture an ultra-slim optical sensor module 110.

That is, since the focal distance between the image sensor 140 and the lens 120 is minimized and the lens 120 is directly disposed on the top surface of the pad 111, a separate barrel structure required for fixing the lens 120 is not necessary. Therefore, although the overall height of the image sensor 140, the substrate 110, and the infrared LEDs which are stacked is considered, it is possible to a ultra-slim optical sensor module 110 of which the height ranges from 0.7 to 2.0 mm.

In the optical sensor module 100, at least one or more infrared LEDs 130 mounted on the top surface of the pad 111 irradiate light right upward. The shadow of a finger (object) or the like, which is generated by the light irradiated from the infrared LEDs 130, is detected by the image sensor 140. Then, a button function through the detection of object position is implemented.

The shadow of the object generated by the light irradiated from the infrared LEDs 130 is vertically incident on the image sensor 140 through the lens 120. The image sensor 140 computes the movement distance and direction of the object in real time by using light condensed by the light receiving section 141 of the image sensor 140 through a short focal distance of the lens 120. Then, the position of the object is detected.

Meanwhile, the manufacturing method of the lens 120 attached to the pad 111 is performed as follows.

FIG. 6 is a diagram for explaining the manufacturing method of the sag lens adopted in the optical sensor module according to the invention.

First, polymer is injected into a mold having a plurality of grooves formed therein, and is then cured by ultraviolet rays so as to form a lens array. Then, a substrate is bonded to the rear surface of the lens array.

Further, the mold is separated from the lens array, and the lens array is diced into a plurality of unit sag lenses 120.

When the polymer is injected into the mold, the polymer is cured by ultraviolet rays in a state where the surface of the polymer is exposed to the air. As the process is repeated, the lens array is formed.

Further, when the substrate is integrated with the rear surface of the lens array, a transparent substrate is used. As ultraviolet rays are irradiated through the transparent substrate, the polymer is cured so that the lens array is integrally attached to the substrate.

In the sag lens 120, deformation caused by the polymer contraction does not occur on the lens surface, but occurs on the exposed surface of the lens. Therefore, compensation for the distorted shape of the lens surface is not necessary. Accordingly, it is possible to manufacture lenses with a high quality and an extremely short focal distance.

According to the optical sensor module of the invention, the plurality of infrared LEDs are mounted around the lens which is closely attached to the top surface of the PCB, and the image sensor surrounded by the housing is closely attached to the bottom surface of the pad. Therefore, it is possible to manufacture an ultra-slim optical sensor module which is built in small-sized electronic devices such as mobile phones. Further, a degree of freedom for the position selection of the lens manufactured in a wafer state increases.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A non-contact optical sensor module comprising:

a printed circuit board (PCB) having a pad with a perforated portion formed in the central portion thereof;

a lens disposed on the top surface of the pad so as to cover the perforated portion;

one or more light sources on the same plane with the lens disposed around the lens;

an image sensor closely attached to the bottom surface of the pad; and a housing mounted to surround the outer periphery of the image sensor, the housing having the same height as that of the image sensor and the same size as that of the pad, wherein the lens is formed of a sag lens manufactured in a wafer state.

2. The non-contact optical sensor module according to claim 1, wherein the PCB is a flexible printed circuit board (FPCB) having the pad provided at one end thereof and a substrate connection portion provided at the other end thereof, the substrate connection portion having a connector mounted thereon.

3. The non-contact optical sensor module according to claim 1, wherein the light sources are composed of infrared light emitting diodes (LEDs), which emit infrared light right upward.

4. The non-contact optical sensor module according to claim 3, wherein in the infrared LEDs, light incident through the lens depending on an external environment enters the image sensor, the intensity of the light is detected by a light quantity detecting section which is separately provided inside or outside the image sensor, and a voltage is adjusted by a circuit built in the substrate such that the illumination intensity of the infrared LEDs is adjusted.

5. The non-contact optical sensor module according to claim 1, wherein the optical sensor module is formed to have a height of 0.7 to 2.0 mm.

* * * * *